US007320476B2

(12) United States Patent
Haldemann

(10) Patent No.: US 7,320,476 B2
(45) Date of Patent: Jan. 22, 2008

(54) SECURE ATTACHMENT OF A BOOT TO A SLIDING BOARD

(75) Inventor: Gaston Haldemann, Engelberg (CH)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 11/214,244

(22) Filed: Aug. 29, 2005

(65) Prior Publication Data

US 2006/0061065 A1 Mar. 23, 2006

(30) Foreign Application Priority Data

Sep. 20, 2004 (CH) ..... 1538/04
Jun. 17, 2005 (EP) ..... 05013137

(51) Int. Cl.
*A63C 9/00* (2006.01)

(52) U.S. Cl. ..... 280/628; 280/629; 280/623; 280/611

(58) Field of Classification Search ..... 280/611, 280/625, 623, 628, 629, 634, 825, 809, 616, 280/617

See application file for complete search history.

(56) References Cited

U.S. PATENT DOCUMENTS 4,989,893 A 2/1991 Kowatsch et al.
5,273,306 A * 12/1993 Wawra ..... 280/625
5,333,891 A * 8/1994 Stritzl et al. ..... 280/625
6,053,523 A * 4/2000 Quillard et al. ..... 280/625
6,092,831 A * 7/2000 Bauvois ..... 280/625
6,779,809 B2 * 8/2004 Thomas et al. ..... 280/623
6,889,996 B2 * 5/2005 Chonier et al. ..... 280/625

FOREIGN PATENT DOCUMENTS

DE 3905616 A * 10/1989
EP 0 320 854 B2 8/1996

* cited by examiner

*Primary Examiner*—Hau Phan
(74) *Attorney, Agent, or Firm*—Frommer Lawrence & Haug LLP; Ronald R. Santucci

(57) ABSTRACT

Toe-piece for attaching a boot to a sliding board, comprising a body (2) and at least one jaw (3) which is rotationally movable about an substantially horizontal axis (5) in accordance with a first bearing on the body (2) for release in the event of a backward fall and rotationally movable about an substantially vertical axis (6) in accordance with a second bearing on the body (2) for release in the event of torsion, wherein the bearing surface between the jaw (3) and the body (2) on the jaw (3) and/or the body (2) has an inclined part (7, 7') to represent a specific setting of the release threshold of the binding for certain particular falls.

8 Claims, 2 Drawing Sheets

Fig.1
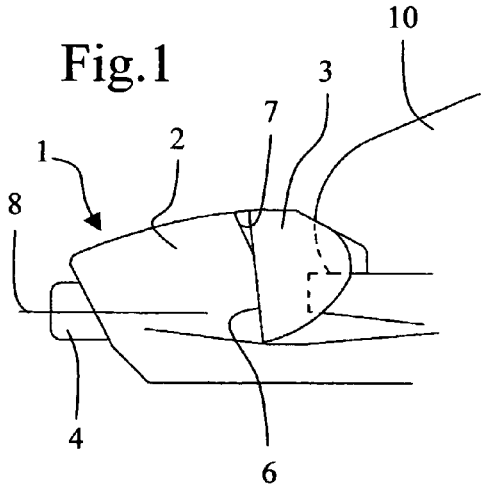
Fig.2
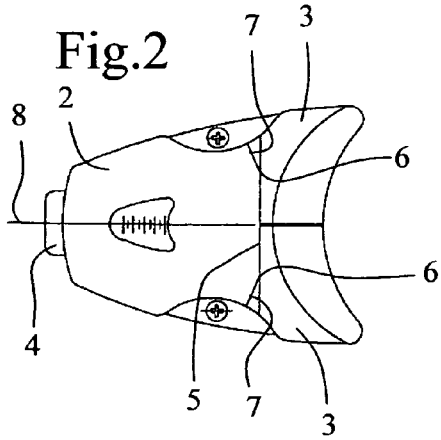
Fig.3
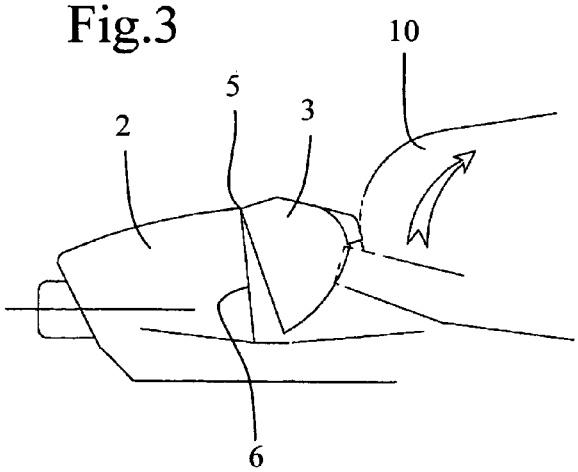
Fig.4
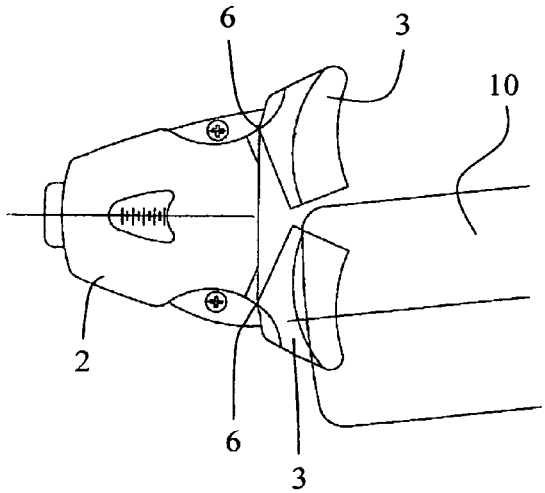
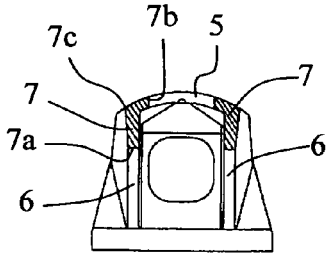
Fig.5
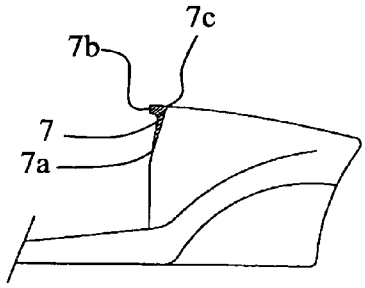
Fig.6
Fig.7
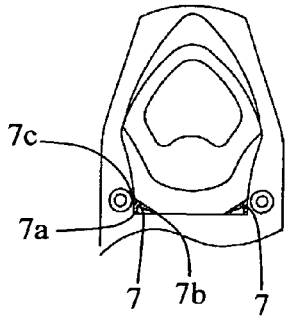

Fig.8
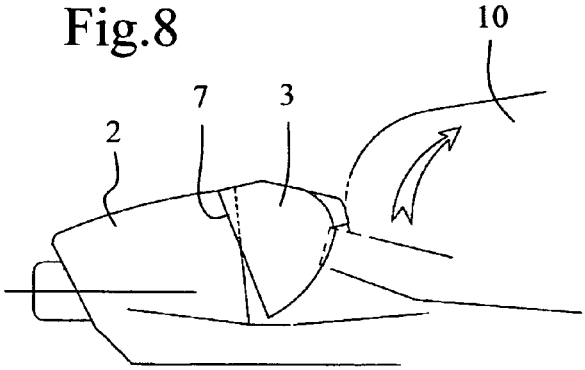
Fig.9
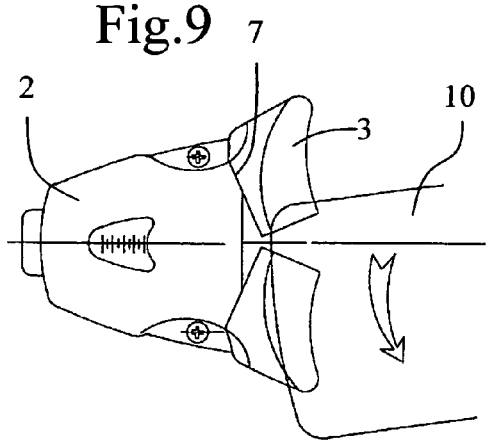
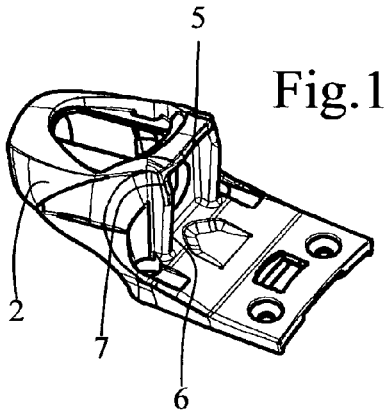
Fig.10
Fig.11
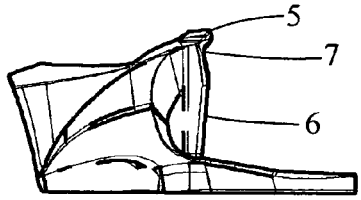
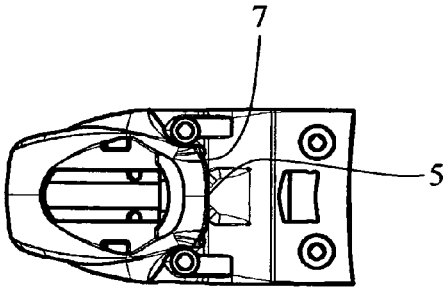
Fig.12
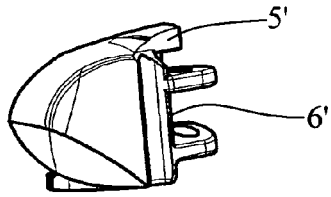
Fig.13
Fig.14
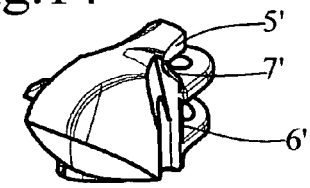

SECURE ATTACHMENT OF A BOOT TO A SLIDING BOARD

This application claims priority benefits from Swiss Patent Application No. 1538/04 filed Sept. 20, 2004 and European Patent Application No. 05013137.4 filed Jun. 17, 2005.

The invention relates to a device for attaching a boot to a sliding board, which is particularly appropriate for safety bindings for a ski boot, that is to say for devices intended for securely retaining a boot on a ski by exerting a pressure on the heel of the boot and by pressing it forward against a front attachment device called a toe-piece, while automatically freeing the boot in the event of the skier falling. It also relates to a ski to which such a device is fixed.

According to the prior art, described in patent EP0320854 for example, a ski binding comprises a heel-piece and a toe-piece for interacting respectively with the rear and the front of a ski boot. Each element of this attachment device is based on a base-plate located on the ski, which interacts with two jaws, the function of which is to retain the boot on the ski. These jaws are connected to the base-plate by means of a spring which makes it possible to free the boot when the force exerted by the boot exceeds a certain threshold. To be more precise, the toe-piece allows lateral rotation of the jaws about a vertical axis in order to free the boot in the event of torsion and allows rotation of the jaws upward about a horizontal axis in order to free the boot in the event of the skier falling backward. For these two movements, the freeing of the jaw is based on the same spring and requires only one setting. In many backward falls of the skier, these two rotations are in fact combined, a torsion movement accompanying the upward thrust, in a fall described as "backward with torsion". The appearance on the market of skis known as carving skis, the characteristic of which is to cut the turn, has increased the risk of accidents associated with these "backward with torsion" falls, which often give rise to serious knee injuries. The ISO standard for ski bindings stipulates a rear stress of 1.25 times the set torque as a permissible overload not to be exceeded for torque at 25% in backward falls combined with torsion. This standard is often too lenient, and current bindings have a specific inadequacy with regard to these backward falls with torsion.

SUMMARY OF THE INVENTION

A first object of the present invention is a device for attaching a boot to a sliding board which improves safety during backward falls with torsion.

A second object of the present invention is a device for attaching a boot to a sliding board which remains simple and inexpensive.

The invention is based on a toe-piece of which the bearing surface between the jaw and the body on the jaw and/or the body has an inclined part to represent a specific setting of the release threshold of the binding for certain particular falls.

It is defined more precisely by the claims.

DESCRIPTION OF THE DRAWINGS

These objects, characteristics and advantages of the present invention will be explained in detail in the description below of particular non-limiting embodiments in connection with the accompanying figures, in which:

FIG. 1 represents a diagrammatic side view of the toe-piece of the attachment device according to the invention in an attachment position without release;

FIG. 2 represents a diagrammatic top view of the toe-piece of the device according to the invention;

FIG. 3 represents a diagrammatic side view of the toe-piece of the attachment device according to the invention in a situation of disengagement toward the rear without torsion;

FIG. 4 represents a diagrammatic top view of the toe-piece of the attachment device according to the invention in a situation of disengagement under torsion without backward stress;

FIG. 5 represents a diagrammatic rear end view of the toe-piece of the attachment device according to the invention;

FIG. 6 represents a diagrammatic side view of the toe-piece of the attachment device according to the invention;

FIG. 7 represents a diagrammatic top view of the toe-piece of the attachment device according to the invention;

FIG. 8 represents a diagrammatic side view of the toe-piece of the attachment device according to the invention in a situation of disengagement toward the rear with torsion;

FIG. 9 represents a diagrammatic top view of the configuration in FIG. 8;

FIG. 10 represents a perspective view of the toe-piece of the attachment device according to the invention;

FIG. 11 represents a side view of the toe-piece of the attachment device according to the invention;

FIG. 12 represents a top view of the toe-piece of the attachment device according to the invention;

FIG. 13 represents a perspective view of a jaw of the toe-piece of the attachment device according to the invention; and FIG. 14 represents a perspective view of a jaw of the toe-piece of an attachment device according to a variant embodiment of the invention.

DESCRIPTION OF THE INVENTION

FIGS. 1 to 9 illustrate diagrammatically an embodiment of the invention for a ski binding.

As illustrated in FIGS. 1 and 2, such a device is based on a toe-piece 1 consisting of a body 2 and two jaws 3. The jaws 3 are connected to the body 2 by a rod located on the axis 8 of the body 2, the rod itself being connected to a spring (not illustrated), the stiffness of which can be adjusted by a front screw 4.

As illustrated in FIG. 3, the jaws 3 are rotationally movable about a horizontal axis 5 which corresponds to the rear upper transverse edge of the body 2. In the event of a backward fall, the jaws 3 take their bearing on this axis 5 in order to turn upward and free the boot 10.

Similarly, the jaws 3 are rotationally movable about an substantially vertical axis 6 which corresponds to a rear edge on each side of the body 2. Such an edge or vertical axis 6 of rotation can be referred to as a "knife". FIG. 4 illustrates the performance of such rotation in the case of a fall under pure torsion, without force toward the rear.

Lastly, the body 2 therefore has on its rear face a U-shaped bearing zone for the jaws 3, which consists of an upper central part 5 and two lateral parts 6. Each of these parts is located in the same substantially vertical plane transverse to the longitudinal direction along the axis 8 of the toe-piece. According to this embodiment of the invention, the U-shaped bearing zone is not entirely coplanar but also has two upper lateral parts 7, corresponding to the corners located between the parts 5 and 6, which have the characteristic of being inclined toward the front in relation to the plane defined by the parts 5 and 6. This part 7 is defined more precisely schematically as a triangular surface portion delimited by a first point 7*a*, at the boundary with the vertical lateral part 6, a second point 7*b*, at the boundary with the central horizontal upper part 5, and a third point 7*c* located in front of the points 7*a* and 7*b* and higher than the point 7*a*. From each of the points 7*a* and 7*b*, the inclination of the axes 5 and 6 changes in a discontinuous manner to form the upper lateral part 7 inclined toward the front of the toe-piece, in relation to a vertical plane transverse to the toe-piece, as is particularly visible in FIGS. 5 to 7. In this embodiment, the jaws remain unchanged and such as they are represented in FIG. 13 for example.

The technical function of the inclined parts 7 is illustrated in connection with FIGS. 8 and 9, which represent the release of the binding in the case of a backward fall with torsion. During such a fall, the jaw tends to rotate upward and at the same laterally toward the outside of the toe-piece and naturally takes its bearing on the part 7 of the bearing zone of the body 2. By virtue of its geometry described above, this inclined part 7 makes the rotation of the jaws easier than if it were in the plane of the other parts 5 and 6, because it results in a modification of the torque, exerted by the combination of the force of the boot 10 counterbalanced by the effect of the spring of the binding, in a way which facilitates the freeing of the boot. Thus, by simple and slight modification of the bearing surface of the body 2 of the toe-piece, it is possible to obtain a different setting of the force necessary for the release of the toe-piece, which is variable according to the type of fall, and without modification of the setting of the release spring.

Depending on the geometry of the inclined plane 7, it is possible to predefine the characteristics of the release according to the torsion and the backward force exerted during a fall. For example, the more the point 7*b* is displaced toward the center of the toe-piece, the more the effect of the invention will apply for weak torsion. In an extreme situation, the concept of the invention can thus be applied to a backward fall with virtually zero torsion. Likewise, the lower the point 7*a*, nevertheless still remaining above the axis of the rod connected to the spring of the toe-piece, that is to say the longitudinal axis 8 of the toe-piece, the more the effect of the invention will apply for a weak vertical force on the jaws in the event of a backward fall. Lastly, the angle of inclination of the surface 7, that is the positioning of the point 7*c*, also defines the intensity of the lowering of the torque exerted. The person skilled in the art will therefore adapt the shape of the bearing surface between the jaws 3 and the body 2 according to the needs of each particular application.

FIGS. 10 to 12 illustrate the preceding embodiment of the invention on a toe-piece in which the jaws are not represented for reasons of better clarity of the essential elements of the invention. FIG. 13 represents a jaw 3 of the toe-piece, the bearing surfaces 5' and 6' of which are intended to come into contact with the bearing surfaces 5 and 6 of the body 2.

According to a variant embodiment represented in FIG. 14, the concept of the invention can be implemented by modification of the surface of the jaws 3 which is intended to come into contact with the body 2 of the toe-piece, the bearing zone on the body 2 then remaining unchanged so as to achieve in an equivalent way the same results as those described above. In this variant embodiment, the bearing surface of the jaw 3 has a surface inclined toward the rear of the toe-piece.

In fact, in all cases, one of the bearing surfaces at least of the body 2 or of the jaws 3 has a surface with an inclined part, and therefore a bearing surface which is not plane overall. According to the embodiments described above, the bearing surface has at least one part of discontinuous inclination, which is different in relation to the surface as a whole. However, the same concept can be implemented with curved surfaces, a part 7, 7' still being distinguished in relation to the bearing surface as a whole by a different inclination for the purpose of modifying the setting of the release of the binding for a specific type of fall.

Furthermore, this concept has been implemented for a specific setting of the release of a binding in the event of a backward fall with torsion but it can apply for any type of fall. It can also be implemented for an opposite setting, that is to say for the purpose of increasing the release threshold of certain types of fall.

The invention claimed is:

1. A toe-piece for attaching a boot to a sliding board, comprising i) a body (2) wherein the body (2):

a) comprises a substantially horizontal axis (5) corresponding to a central, traverse, substantially horizontal upper rear edge of the body (2), and b) comprises two substantially vertical axes (6) corresponding to a lateral, substantially vertical lower rear edge of the body (2), ii) at least one jaw (3) wherein the jaw (3) is a) rotationally movable about a substantially horizontal axis (5) in accordance with a first bearing of the jaw (3) on horizontal axis (5) of the body (2) for release in the event of a backward fall, and b) rotationally movable about a substantially vertical axis (6) in accordance with a second bearing of the jaw (3) on vertical axis (6) of the body (2) for release in the event of torsion, wherein the jaw (3) takes a bearing relative to the body (2) on an inclined surface (7) for release in the event of backward fall combined with torsion, this inclined surface (7) being on the body (2) intermediate between the horizontal axis (5) and the vertical axis (6) and being inclined relative to these two axes (5,6) and oriented toward the front of the toe-piece.

2. The attachment toe-piece as claimed in claim 1, wherein the bearing surface (5, 6, 7; 5', 6', 7') between the jaw (3) and the body (2), which is located on the jaw (3), the body (2), or both the jaw (3) and the body (2), is substantially non-coplanar.

3. The attachment toe-piece as claimed in claim 1, wherein the bearing surface (5, 6, 7; 5', 6', 7') between the jaw (3) and the body (2), which is located on the jaw (3), the body (2), or both the jaw (3) and the body (2), has a discontinuous inclination in relation to a vertical and/or horizontal direction to form the inclined part (7, 7').

4. The attachment toe-piece as claimed in claim 1, wherein the inclined part (7) has an inclination toward the front of the toe-piece from a point (7*a*) of the vertical lateral axis (6) located above the longitudinal axis (8) of the toe-piece bearing a spring-rod assembly.

5. The attachment toe-piece as claimed in claim 4, wherein the inclined part (7) has an inclination toward the front of the toe-piece from a point (7*b*) of the horizontal lateral axis (5) to facilitate the release of the binding in the event of a backward fall with torsion.

6. An attachment device comprising i) a body (2) wherein the body (2):

a) comprises a substantially horizontal axis (5) corresponding to a central, traverse, substantially horizontal upper rear edge of the body (2), and b) comprises two substantially vertical axes (6) corresponding to a lateral, substantially vertical lower rear edge of the body (2), ii) at least one jaw (3) wherein the jaw (3) is a) rotationally movable about a substantially horizontal axis (5) in accordance with a first bearing of the jaw (3) on horizontal axis (5) of the body (2) for release in the event of a backward fall, and b) rotationally movable about a substantially vertical axis (6) in accordance with a second bearing of the jaw(3) on vertical axis (6) of the body (2) for release in the event of torsion, wherein the jaw (3) takes a bearing relative to the body (2) on an inclined surface (7) for release in the event of backward fall combined with torsion, this inclined surface (7) being on the body (2) intermediate between the horizontal axis (5) and the vertical axis (6) and being inclined relative to these two axes (5,6) and oriented toward the front of the toe-piece.

7. A ski comprising an attachment device which comprises i) a body (2) wherein the body (2):

a) comprises a substantially horizontal axis (5) corresponding to a central, traverse, substantially horizontal upper rear edge of the body (2), and b) comprises two substantially vertical axes (6) corresponding to a lateral, substantially vertical lower rear edge of the body (2), ii) at least one jaw (3) wherein the jaw (3) is a) rotationally movable about a substantially horizontal axis (5) in accordance with a first bearing of the jaw (3) on horizontal axis (5) of the body (2) for release in the event of a backward fall, and b) rotationally movable about a substantially vertical axis (6) in accordance with a second bearing of the jaw (3) on vertical axis (6) of the body (2) for release in the event of torsion, wherein the jaw (3) takes a bearing relative to the body (2) on an inclined surface (7) for release in the event of backward fall combined with torsion, this inclined surface (7) being on the body (2) intermediate between the horizontal axis (5) and the vertical axis (6) and being inclined relative to these two axes (5,6) and oriented toward the front of the toe-piece.

8. A toe-piece for attaching a boot to a sliding board, comprising i) a body (2) wherein the body (2):

a) comprises a substantially horizontal axis (5) corresponding to a central, traverse, substantially horizontal upper rear edge of the body (2), and b) comprises two substantially vertical axes (6) corresponding to a lateral, substantially vertical lower rear edge of the body (2), ii) at least one jaw (3) wherein the jaw (3):

a) comprises a horizontal upper anterior edge (5'), b) comprises a substantially vertical anterior edge (6'), c) is rotationally movable about a substantially horizontal axis (5) in accordance with a first bearing of horizontal axis (5') of the jaw (3) on horizontal axis (5) of the body (2) for release in the event of a backward fall, and d) is rotationally movable about a substantially vertical axis (6) in accordance with a second bearing of vertical axis (6') of the jaw (3) on vertical axis (6) of the body (2) for release in the event of torsion, wherein the jaw (3) takes a bearing relative to the body (2) on an inclined surface (7') for release in the event of backward fall combined with torsion, this inclined surface (7') being on the jaw (3) intermediate between the horizontal edge (5') and the vertical anterior edge (6') and oriented toward the rear of the toe-piece.

* * * * *